United States Patent [19]

Arai

[11] Patent Number: 4,652,141

[45] Date of Patent: Mar. 24, 1987

[54] TIME APPARATUS

[75] Inventor: Michio Arai, Saitama, Japan

[73] Assignee: Arai Helmet Co., Ltd., Ohmiya, Japan

[21] Appl. No.: 798,937

[22] Filed: Nov. 18, 1985

[30] Foreign Application Priority Data

| | | | |
|---|---|---|---|
| Nov. 19, 1984 | [JP] | Japan | 59-176148[U] |
| Nov. 19, 1984 | [JP] | Japan | 59-176149[U] |
| Jul. 29, 1985 | [JP] | Japan | 60-116937[U] |
| Jul. 31, 1985 | [JP] | Japan | 60-118796[U] |

[51] Int. Cl.[4] ..... G04B 37/00

[52] U.S. Cl. ..... 368/278; 368/10; 368/69

[58] Field of Search ..... 368/286, 10, 69, 278

[56] References Cited

U.S. PATENT DOCUMENTS

| | | | |
|---|---|---|---|
| 4,337,529 | 6/1982 | Morokawa | 568/109 |
| 4,526,479 | 7/1985 | Harris | 368/109 |

FOREIGN PATENT DOCUMENTS

| | | | |
|---|---|---|---|
| 1557503 | 3/1968 | France | 368/286 |

*Primary Examiner*—Bernard Roskoski

*Attorney, Agent, or Firm*—Oblon, Fisher, Spivak, McClelland & Maier

[57] ABSTRACT

A time apparatus is disclosed which enables autocycle riders, marathon athletes, jogging runners, skiers etc. to see or check time only by the pushing motion of the thumb of the hand which wears the apparatus, without the need of the other hand.

8 Claims, 13 Drawing Figures

TIME APPARATUS

BACKGROUND OF THE INVENTION

1. Field of the Invention

This invention relates to a time apparatus and, more particularly, to a time apparatus which functions as a watch and/or stopwatch, and a glove provided with such time apparatus, for use of autocycle riders, car drivers, marathon athletes, jogging runners, skiers, etc.

2. Description of the Prior Art

Generally, in the even where a marathon athlete for example, checks time, he manipulates his stop watch type wrist watch at start and goal by his hand the watch is not weared. If he wishes to check lap time during running, he has to move his hand to that wearing the watch so as to manipulate the watch button. This situation is not preferable since his energy is not concentrated to running.

Autocycle riders and car drivers may wish to see wrist watches to see time or to check time spent. But it is difficult or dangerous to do so during riding. If riders wear drivers' gloves, watches may be covered by the gloves and the watches cannot be seen without rolling us the ends of gloves, and the riders are unable to roll up the ends during riding. Further, riders cannot check lap time spent for a certain distance by themselves without the help of co-riders.

SUMMARY OF THE INVENTION

Purpose of the Invention

One of the objects of the invention is to provide a time apparatus which can be manipulated by the hand the apparatus is weared and without the need of the working of the hand the apparatus is not weared.

Another object of the invention is to provide a glove provided removably with time means comprising a time indicator and switches.

Still another object of the invention is to provide a time apparatus which can be operated only by a minimum action of fingers of the hand wearing the apparatus. Various advantages and features of novelty which characterize the invention are pointed out with particular in the claims aneexed hereto and forming a part hereof. However, for a better understanding of the invention, its advantages, and objects attained by its use, reference should be had to the drawing which forms a further part thereof, and to the accompanying descriptive matter, in which there is illustrated and described a preferred embodiment of the invention.

DESCRIPTION OF THE PREFERRED EMBODIMENT

Figure 1:
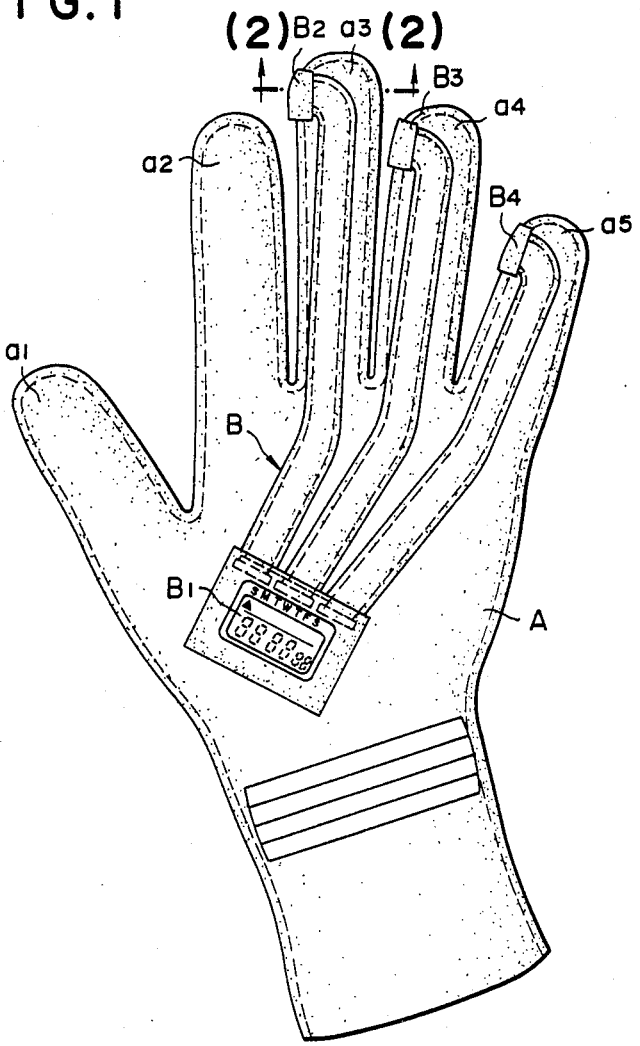
FIG. 1 is a plan view of one embodiment of the glove provided with the time apparatus, for autocycle riders, embodying the invention.
Figure 2:
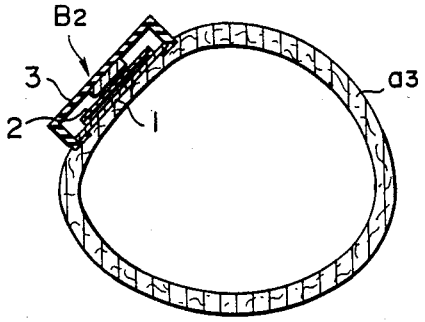
FIG. 2 is an enlarged sectional view along the line (2)—(2) of FIG. 1.
Figure 3:
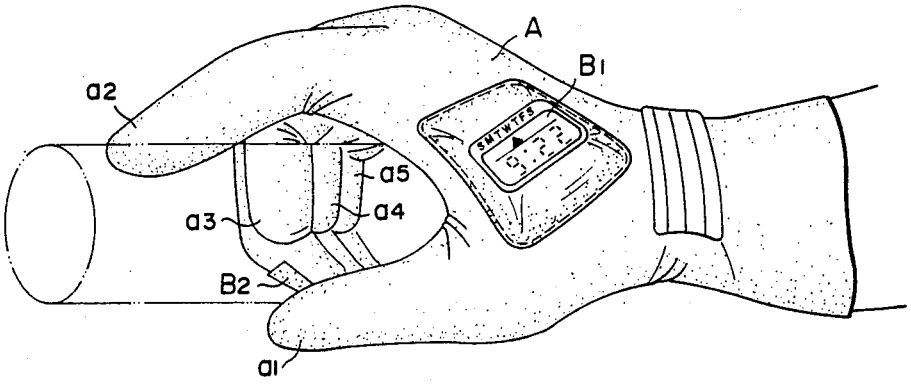
FIG. 3 is a perspective view of the glove showing the state of manipulating a switch during grasping an accelerator grip.

In the first embodiment shown in FIGS. 1 through 3, a time apparatus of the invention is mounted to an apparatus-fixing means in a form of a glove. In these figures, a symbol A indicates said fixing means or a right hand glove and B is time means. The glove A has well known shape and structure of material excellent in keeping warm and flexible property, and is provided at its back surface with the time means B.

The time means B comprises electrical time indicator $B_1$ and switches $B_2$, $B_3$ and $B_4$ for manipualting the motion at the time indicator $B_1$. The time indicator $B_1$ is positioned at the cross of the lines extended from a thumb $a_1$ and a forefinger $a_2$ when they are opened substantially to a V shape. Switches $B_2$, $B_3$ and $B_4$ are provided at the fingers other than the thumb, for example, the thumb side of top of the middle finger $a_3$, third finger $a_4$, and little finger $a_5$, respectively.

The time indicator $B_1$ is used to digitally indicate time by means of liquid crystal for example. The indicator may display present time as a watch, and/or lap time as a stop watch, and may be provided with a lamp for easy recognizing of the present time in night.

The time indicator $B_1$ comprises a synthetic resin case in which a liquid crystal indicator and electrical circuit connections etc., are compactly housed. The connections are preferably printed in flexible resin film or sheet and connected to switches $B_2$, $B_3$ and $B_4$, which are provided at the thumb-side end of fingers $a_3$, $a_4$ and $a_5$.

These switches $B_2$, $B_3$ and $B_4$ are formed to be connected when pushed, and comprise a base plate 1 of electrode-printed resin sheet or film, a plated contact 1, and a rubber case 3 for housing members 1 and 2, respectively. The case 3 can be pushed down. These switches are fixed to the thumb side of fingers by means of adhesive, etc.

If switches are fixed to the middle finger $a_3$, the third finger $a_4$ and the little finger $a_5$, the switch $B_2$ at the middle finger may be used as light when the time means works as a watch, and used to start or stop the means when used as a stop watch, the switch $B_3$ at the third finger may be used to start lap time or to reset the time for the stop watch, and the switch $B_4$ of the little finger may be used to change mode between watch and stop watch.

The switches are not limited to the above, and a switch to raise the alarm, for example, may be provided.

The time indicator $B_1$ is fixed to the glove means A in a way to prevent hand from freely moving and the glove from flexibly bending, since the hand which wears the glove rotates a grip and holds a brake lever.

Figure 4:
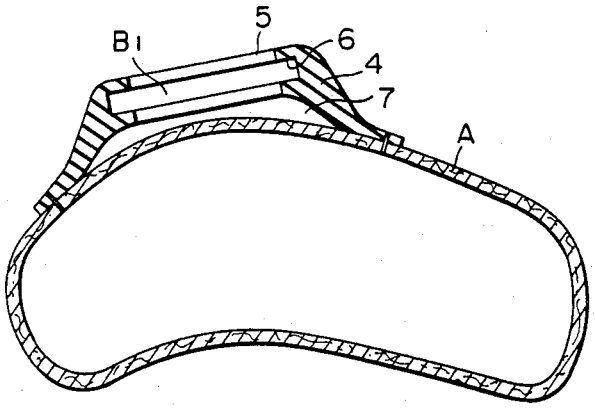
FIG. 4 is an enlarged sectional view of the fixing structure of the time indicator.

An embodiment of the fixing structure is shown in FIG. 4, in which a fixing base 4 is provided on the back surface of the glove A so as to receive the time indicator $B_1$. The fixing base 4 of flexible and elastic material, such as rubber or soft synthetic resin, has substantially trapezoid shape, and is provided with a window 5 at its center. Within the window is formed a setting recess 6 for receiving the indicator $B_1$. Further, a space 7 is formed between the glove surface A and the lower surface of the base 4.

The fixing base 4 may be fixed to the glove by seaming the circumference of the base, heat welding, high frequency adhesion or other known techniques.

Figure 5:
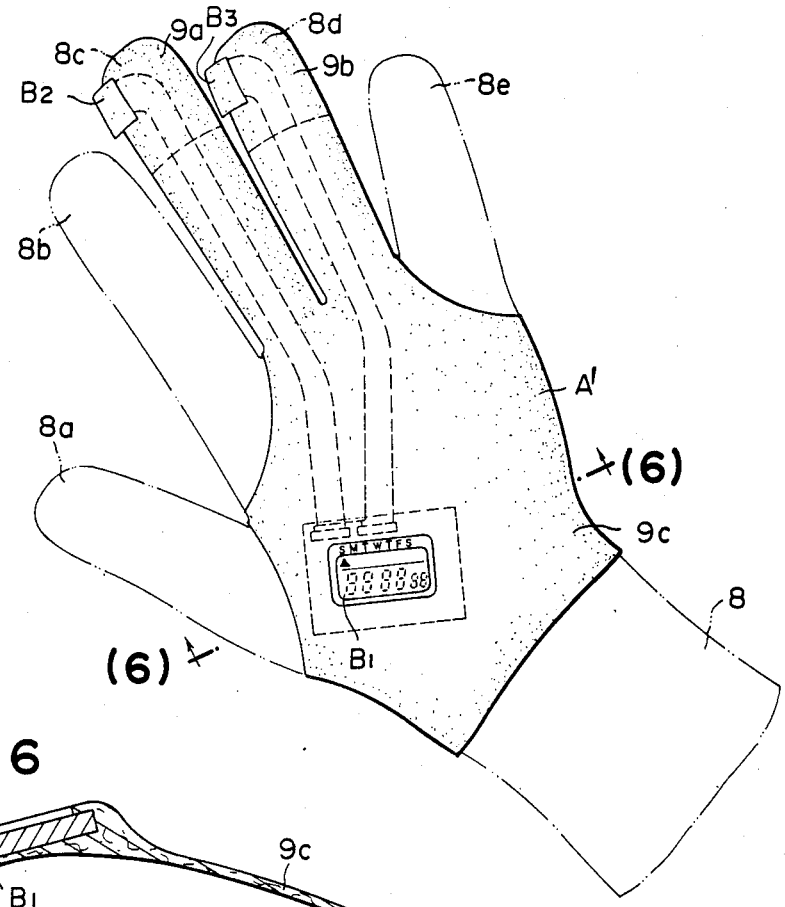
FIG. 5 is a plan view of another embodiment of the glove provided with the time apparatus of the invention.
Figure 6:
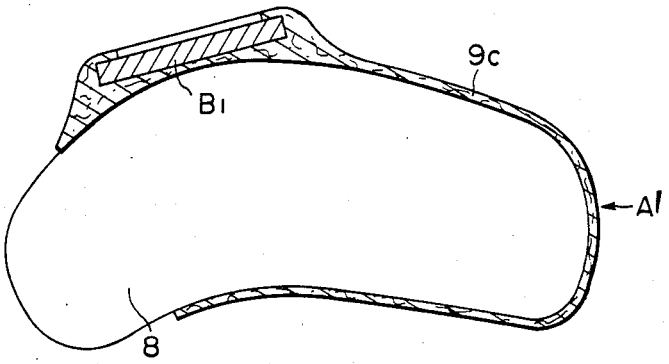
FIG. 6 is an enlarged sectional view taken along the line (6)—(6) of FIG. 5.
Figure 7:
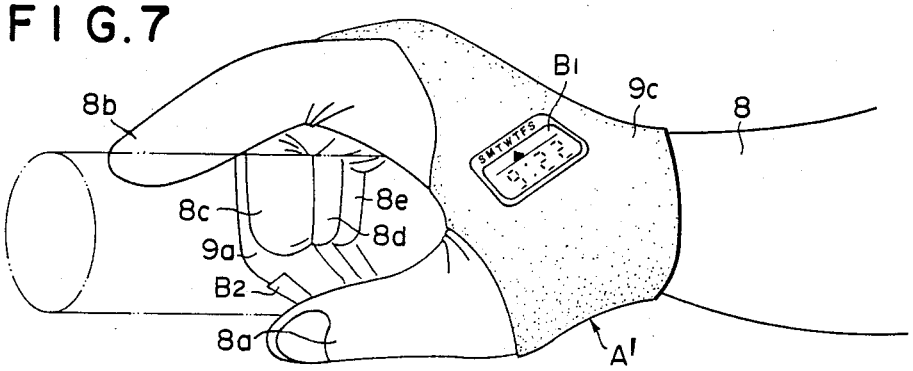
FIG. 7 is a perspective view of the glove showing the similar state illustrated in FIG. 3.

FIGS. 5 through 7 illustrate another embodiment of the apparatus-fixing means in a form of a glove. The glove A' of material smooth-flexible end comfortably fits to fingers, such as leather, cloth or synthetic resin, comprises finger sacks 9*a*, 9*b* formed to fit to the middle finger 8*c* and the third finger 8*d*, for example, which are other than the thumb 8*a*, and a cylinder 9*c* which covers the palm and the back of the hand.

The cylinder 9*c* is provided at its back with a time indicator $B_1$ of a time means B, while the sacks 9*a*, 9*b* have switches $B_2$, $B_3$ at their thumb-side end. The indicator and switches are connected by electical circuits printed in soft resin film or sheet which will not prevent hand from freely moving.

In FIGS. 5 through 7, the time indicator and switches are similar to the one previously explained and similar members have same references.

Explanation has been made as above, with reference to glove means to which the time means is integrally fixed. A reference is made hereinafter concerning a time apparatus wherein the time means can be separated from the glove means.

Figure 8:
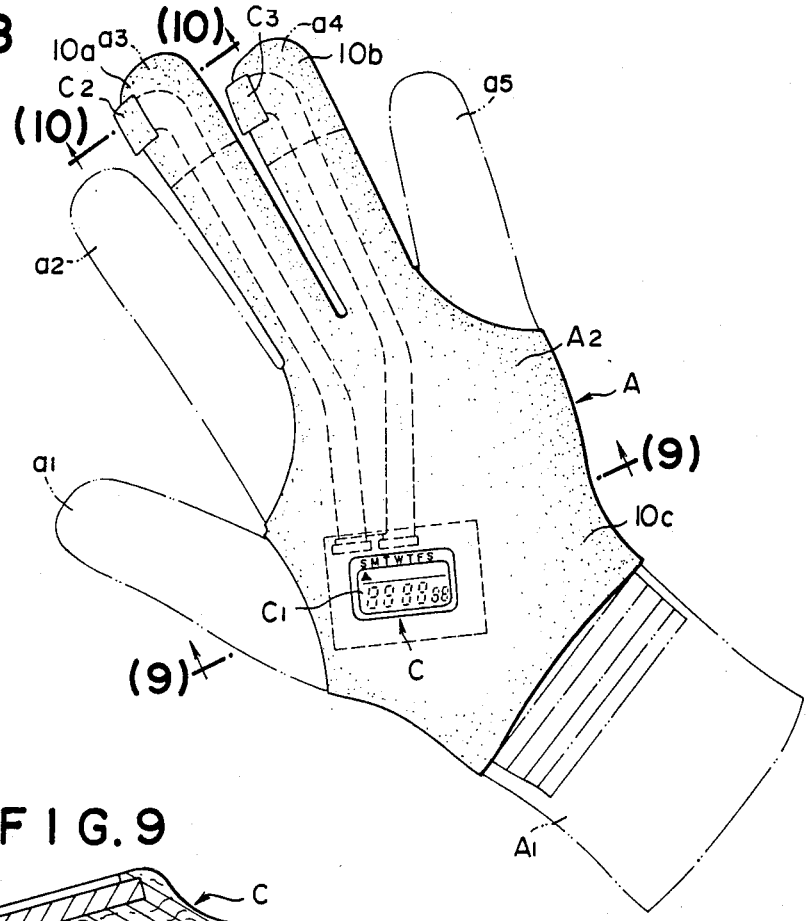
FIG. 8 is a plan view of a glove showing that the time apparatus is removably secured to the glove.
Figure 9:
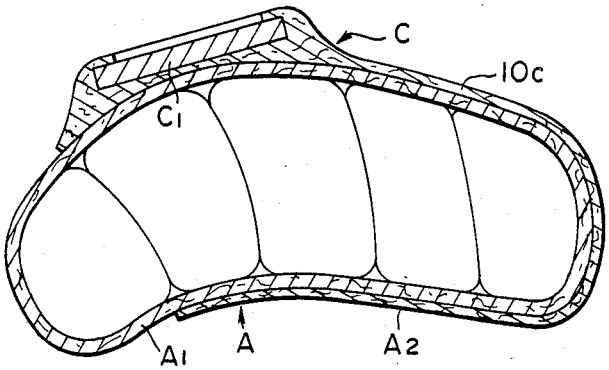
FIG. 9 is an enlarged sectional view taken along the line (9)—(9) of FIG. 8.
Figure 10:
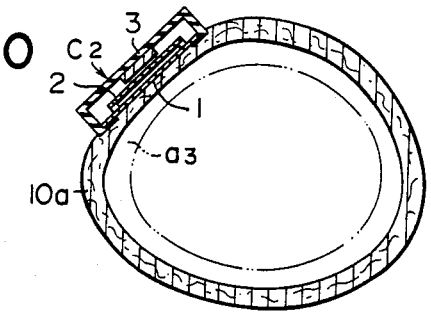
FIG. 10 is an enlarged sectional view taken along the line (10)—(10) of FIG. 8.

FIGS. 8 through 10 illustrate a separably covered mechanism consisting a main glove means $A_1$ and a sub-means $A_2$ which covers the main means. The sub-means $A_2$ is provided at its surface with time means C.

The removable covering means $A_2$ of flexible leather, cloth or vinyl material, consists of finger sacks 10*a*, 10*b* formed to cover the middle finger $a_3$ and the third finger $a_4$ for example, and of a cylinder 10*c* which is applied to the palm and the back of the driver's hand. The cylinder 10*c* is provided at its back integrally with a time indicator $C_1$, and the sacks 10*a*, 10*b* are provided at their thumb-side end with switches $C_2$, $C_3$.

With the strucutre as above, the covering means $A_2$ provided with the time indicator $C_1$ and switches $C_2$, $C_3$ can be separated from the main glove means $A_1$. The time indicator and switches are similar to those as previously mentioned.

Figure 11:
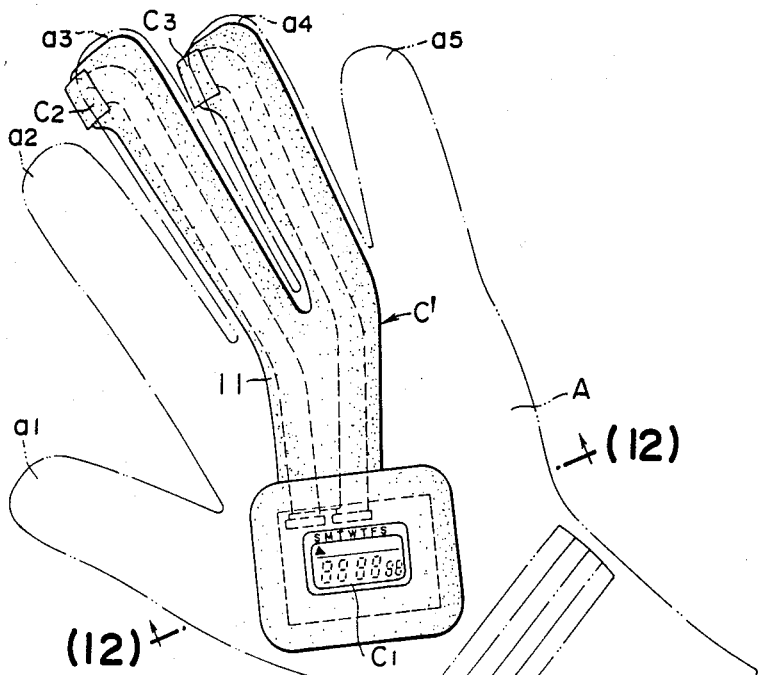
FIG. 11 is a plan view of still another embodiment of the glove showing the removable structure of the apparatus-fixing means and the time means.
Figure 12:
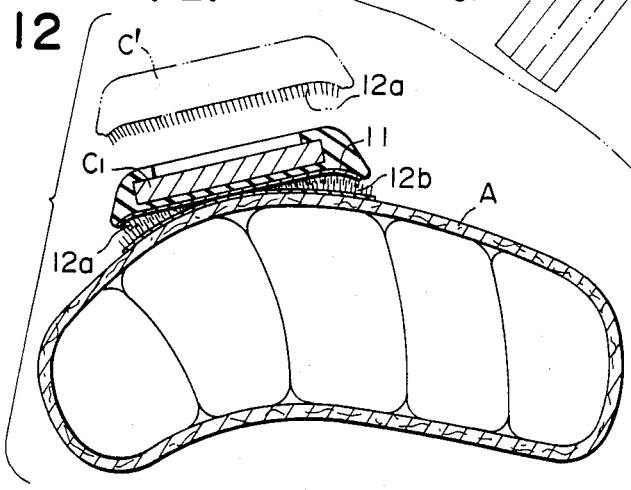
FIG. 12 is an enlarged sectional view taken along the line (12)—(12) of FIG. 11; and, FIG. 13 is a perspective view showing how the switch is operated.
Figure 13:
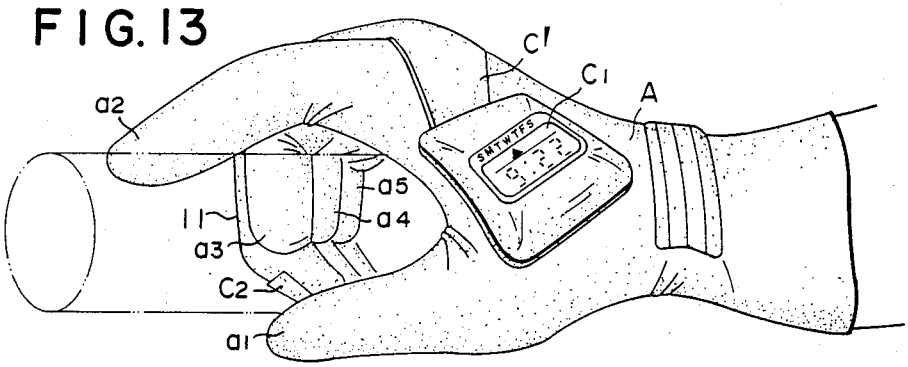

FIGS. 11 through 13 show another separable structure of glove means A and the time means C', in which the glove means A is provided with a velvet type faster 12*b*, while a fixing base 11 is provided with a velvet type fastener 12*a*. The faster 12*a* is removably fixed to the faster 12*b* when necessary and, thus, the base 11 on which a time indicator $C_1$, switches $C_2$, $C_3$, and printed circuit are provided, is secured to the glove means A.

It is of course possible to use double-face adhesive tape in place of the velvet type faster, to secure the time means C' to the glove A.

In operation, after the glove is applied to the hand, any one of switches $B_2$, $B_3$ and $B_4$ or $C_2$, $C_3$ are pushed by the thumb depending on the particular desire of the user. In this way, time or lap time is indicated in the time indicator $B_1$ or $C_1$.

If the time apparatus is applied to an autocycle rider's glove, the time means B or C, C' is secured to the rigid hand glove which grasps the accelerator grip. The rider can move his right hand thumb so as to push the switch provided in the thumb-side of the other finger, without the need of handing off the grip. Since the time indicator is positioned at the cross of the thumb and the forefinger of the right hand glove, the rider can see the indicator at its riding posture. Further, since the switch operation can be effected by a minimal operation of the thumb, the rider or driver feels no inconvenience in riding or driving.

In the event where the time means consisting of the time indicator and switches is secured to the glove means in a removable manner, the time means can be removed from the glove if necessary after long use, so that old, damaged glove can be replaced by a new one.

The apparatus can be used also by jogging runners and marathon athletes conveniently only by the operation of the thumb of the hand which is applied with the apparatus.

The invention has thus been explained in detail with reference to preferred embodiments. It is appreciated that combination and arrangements of the members used for the invention may be modified without departing from the spirit of the appended claims.

What is claimed is:

1. A stopwatch timing apparatus comprising:

an electrical time measuring device having means for measuring variable time intervals;

apparatus-fixing means for holding said electrical time measuring device on a back side thereof and shaped so as to cover the fingers, palm and back of a user's hand in a removable manner;

electrical switch means in said apparatus-fixing means located at the fingers of said user other than the thumb for actuating said time measuring device by movement and contact of the users' thumb and the user's other fingertips on the same hand.

2. A time apparatus according to claim 1, wherein the apparatus-fixing means has a form of a glove.

3. A time apparatus according to claim 1, wherein the apparatus-fixing means consists of finger sacks to which said switch means for said time measuring device is provided, and a cylinger covering the palm and the back of a hand.

4. A time apparatus according to claims 1, 2 or 3 wherein the time measuring device comprising the time indicator and said switch means are secured integrally to the apparatus-fixing means.

5. A time apparatus according to claims 1, 2 or 3 wherein the time measuring device comprising the time indicator and said switch means is secured removably to the apparatus-fixing means.

6. A time apparatus according to claim 5, wherein the time measuring device is positioned at the cross of the thumb and the forefinger, on the back of the apparatus-fixing means.

7. A time apparatus according to claim 5, wherein means for removably fixing the time measuring device comprising the time measuring device and said switch means, is constructed double layer structure.

8. A time apparatus according to claim 5, wherein means for removably securing said time measuring device comprises a velvet type fastener.

* * * * *